United States Patent [19]

McLean

[11] 3,941,284

[45] Mar. 2, 1976

[54] APPARATUS FOR DISCHARGING MATERIALS FROM HOPPERS

[76] Inventor: Reuben Fraser McLean, 3 Westbourne Crescent, Bearsden, Glasgow, Scotland

[22] Filed: May 13, 1974

[21] Appl. No.: 469,706

Related U.S. Application Data

[63] Continuation-in-part of Ser. No. 243,099, April 11, 1972, abandoned, which is a continuation of Ser. No. 34,349, May 4, 1970, abandoned.

[30] Foreign Application Priority Data

May 23, 1969 United Kingdom ..... 26344/69

[52] U.S. Cl. ..... 222/202

[51] Int. Cl.[2] ..... B65G 65/70

[58] Field of Search ..... 222/199, 202, 196; 259/1 R; 198/220 BC

[56] References Cited

UNITED STATES PATENTS

| | | | |
|---|---|---|---|
| 2,568,332 | 9/1951 | Genovese | 222/199 X |
| 3,261,508 | 7/1966 | Wahl | 222/199 |
| 3,278,090 | 10/1966 | Wahl | 222/199 |
| 3,438,677 | 4/1969 | Redpath | 259/1 R X |

*Primary Examiner*—Robert B. Reeves
*Assistant Examiner*—John P. Shannon
*Attorney, Agent, or Firm*—Norris & Bateman

[57] ABSTRACT

A hopper or storage bin having an apparatus for promoting the discharge of material from the hopper including a generally conical material support member with a central discharge opening located beneath the hopper and a generally conical baffle on the support member above the discharge opening. Both the baffle and the support member are vibrated in the region of a resonant frequency of each to promote predominantly natural flexural vibration of each.

11 Claims, 2 Drawing Figures

APPARATUS FOR DISCHARGING MATERIALS FROM HOPPERS

Figure 2:
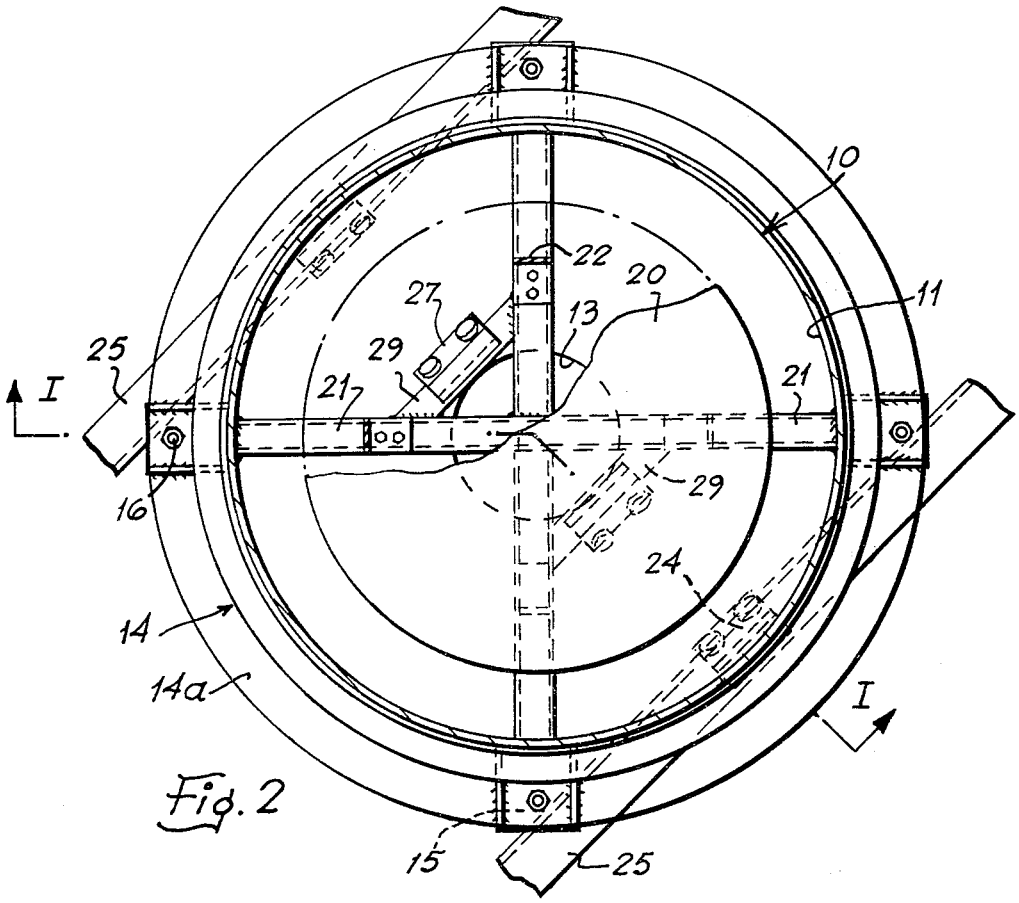

This is a continuation-in-part of my copending application Ser. No. 243,099 filed Apr. 11, 1972 (now abandoned) which in turn was a continuation of Ser. No. 34,349 filed May 4, 1970 (now abandoned).

This invention concerns apparatus for promoting material flow from a storage bin or hopper.

In many industries materials in granular, powdered, or other particulate form are stored in hoppers or bins and need to be discharged therefrom in a controlled manner as part of an industrial process. The varieties of apparatus which have been proposed for promoting the discharge of material from a storage bin or hopper are legion. Amongst the most successful types of apparatus for this purpose are those which utilise the mechanical vibration of certain parts, in the sense that those parts are bodily moved in space in a reciprocatory or gyratory manner. Such apparatus has not, however, been wholly satisfactory for handling a comprehensive range of different materials.

It is an object of the present invention to provide improved apparatus for promoting material flow from a storage bin or hopper, which is capable of successful performance with a wide range of different materials.

According to the present invention, apparatus for promoting material flow from a storage bin or hopper comprises a material supporting member having a discharge opening therein and adapted to be mounted beneath the outlet of the bin or hopper, baffle means disposed in spaced relationship above the discharge opening to prevent direct flow of material therethrough, means for exciting said material supporting member at or in the region of a resonant frequency thereof and means for exciting said baffle means at or in the region of a resonant frequency thereof, so as to promote predominantly flexural vibration of said material supporting member and said baffle means.

Both here and throughout the specification and claims by "flexural vibration" we mean a mode of vibration wherein nodes and antinodes are defined on the member being excited as opposed to localised vibratory deformation at the position of excitation. It will, of course, be understood that such flexural vibration is quite different from vibration wherein the member moves bodily in space in a reciprocatory or gyratory fashion.

The invention will be further apparent from the following description with reference to the figures of the accompanying drawing which show, by way of example only, one form of apparatus embodying the invention.

Of the drawing:-

Figure 1:
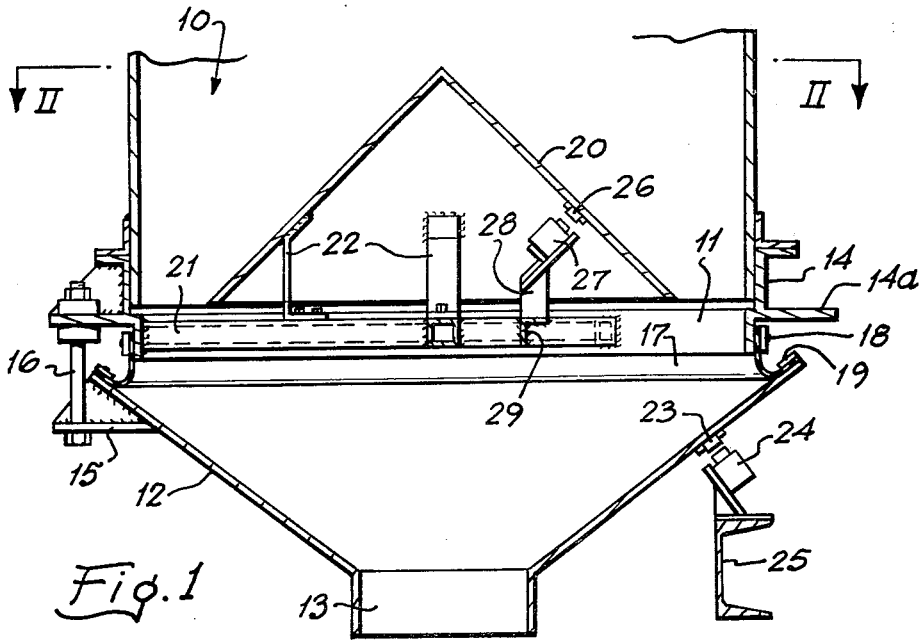

FIG. 1 shows a vertical cross-section through a storage bin fitted with the apparatus of the invention on the line I—I of FIG. 2;

and FIG. 2 shows a partially cut-away cross-section of the bin on the line II—II of FIG. 1.

As can clearly be seen from the drawing, the storage bin, generally indicated at 10 comprises a cylindrical shell having a circular outlet 11 at its lower end.

A material supporting member 12, generally in the form of an inverted truncated conical shell, and provided with a discharge opening 13, is mounted beneath the outlet 11. An annular frame member 14 is secured to the base of the storage bin 10 thus to define the outlet 11 and provide an outwardly directed circumferential flange 14*a*. Four bracket members 15 are secured to the periphery of the material supporting member 12 externally adjacent the upper edge thereof, and are angularly spaced from one another by 90°. Each of the brackets 15 is rigidly connected with the flange 14*a* by means of a bolt 16.

A flexible sleeve 17 extends between the lower edge of the annular frame member 14 and the upper edge of the material supporting member 12, and is secured by means of anchoring strips 18 and 19, thus to form a seal between the storage bin 10 and material supporting member 12.

A baffle in the form of a right conical shell 20 is mounted in spaced relationship above the discharge opening 13 and is supported by crossmembers 21 whose ends are secured to the frame member 14, there being four brackets 22 angularly spaced from one another by 90° extending between the underside of the conical shell and the crossmembers 21.

Means to excite the material supporting member 12 is provided and is comprised by two diametrically opposed pole pieces 23 secured to the underside of the material supporting member 12 at positions between adjacent brackets 15 and in opposed spaced relationship from electro-magnets 24 rigidly secured to frame members 25.

Means to excite the conical shell 20 is provided and comprised by two diametrically opposed pole pieces 26 secured to the underside of the shell 20 at positions between adjacent brackets 22 and in opposed spaced relationship from electro-magnets 27 which are rigidly secured to brackets 28 anchored to ribs 29 extending between the crossmembers 21.

In use, alternating current is applied to the electromagnets 24 and 27 at frequencies which are sufficiently close to resonant frequencies of the material supporting member 12 and conical shell 20 respectively as to cause these parts to vibrate in a predominantly flexural mode.

It will be understood that the material supporting member 12 and conical shell 20 must be designed and mounted so as to be inherently capable of vibrating flexurally. Thus, whilst the parts will not be of flimsy construction, they will be designed to flex between the points at which they are mounted. These points will be selected to define nodes on the members when they are vibrated and to this extent will, amongst other parameters such as the thickness and the diameter thereof, determine the frequency at which the members must be excited. It will be understood that the members may be vibrated at their fundamental frequency or at a harmonic thereof.

Experimental work has shown that apparatus constructed and adapted to operate as described above behaves in a particularly efficacious manner and is capable of successfully discharging a wide range of materials including those regarded as normally being difficult to handle, such as wet sand or carbon black, for example.

The resonant frequencies of the members 12 and 20 will be affected by the load thereon. Means may be provided automatically to vary the frequency of excitation as the contents of the storage bin are dispensed. Alternatively and preferably, since the expected variation is not high, the excitation means are tuned so that the exact resonant conditions are encountered as the storage bin is emptied.

It will be appreciated that it is not intended to limit the invention to the above example only, many variations, such as might readily occur to one skilled in the art, being possible, without departing from the scope thereof.

Thus, for example, the material supporting member need not be rigidly secured to the underside of the storage bin and may be suspended by flexible means.

Again, for example, the means of exciting the material supporting member and baffle need not be comprised by electro-magnets but could, for example, be constituted by electric motors having eccentric weight mounted on their shafts.

Yet again, for example, when it is possible to design the baffle to have the same resonant frequency as the material supporting member the former may be excited by means of a rigid mechanical connection between the two.

Yet again, for example, two excitation means need not be provided for each part to be vibrated, one such means will suffice in many applications, and more than two such means may be provided if desired.

It will be understood that when apparatus embodying the invention is installed, it will be convenient if mains frequency can be used as the excitation frequency, the members to be vibrated being designed and mounted with this end in view. In order to achieve exact adjustment it may be necessary to "tune" these members and this may be achieved by adding weights thereto, cutting slits therein or applying forces thereto by springs or other resilient means.

What is claimed is:

1. Apparatus for promoting material flow from a storage bin or hopper comprising a material supporting member having material contacting walls capable of flexural vibration and having a discharge opening therein, means for mounting said member beneath the outlet of a bin or hopper comprising means for securing said member to said bin or hopper at least at some of an even number of positions around said member, which positions are nodal positions when the member is excited at or near resonant frequency and there being antinodal regions between said positions, baffle means disposed in spaced relationship above the discharge opening to prevent direct flow of material therethrough, and vibrator means acting on the walls of said member in at least one of said antinodal regions exciting said material supporting member at or in the region of a resonant frequency thereof so as to promote predominantly flexural vibration of said material supporting member.

2. Apparatus according to claim 1 wherein said material supporting member is generally in the form of an inverted truncated conical shell.

3. Apparatus according to claim 1 wherein said means for exciting said material supporting member is comprised by at least one electro-magnet mounted externally of the member between adjacent nodal positions where the member is mounted.

4. Apparatus according to claim 3 wherein each said electro-magnet is located in spaced relationship from a pole piece rigidly secured to the material supporting member.

5. Apparatus according to claim 1 wherein means is provided for securing said baffle means to the bin or hopper at least at some of an even number of positions around said baffle means, which positions are nodal positions when the baffle means is excited at or near resonant frequency, and means is provided for exciting said baffle means and is comprised by at least one electro-magnet mounted on the baffle means at a position between adjacent positions where the baffle means is mounted.

6. Apparatus according to claim 5 wherein each said electro-magnet is mounted in spaced relationship from a pole piece secured rigidly to the baffle means.

7. Apparatus according to claim 1 wherein both said material supporting member and said baffle means are mounted at four equi-angularly spaced locations around their peripheries.

8. Apparatus according to claim 1, wherein said material supporting member is mounted upon said bin or hopper, said baffle member is mounted on said bin or hopper, and a flexible annulus sealingly connects the outlet of said bin or hopper to said material supporting member.

9. Apparatus according to claim 1, wherein baffle means is mounted in spaced relationship above the outlet of the bin or hopper to prevent direct discharge of material therethrough and means is provided for separately exciting said baffle means at or in the region of its natural frequency so as to promote predominantly flexural vibration thereof.

10. Apparatus according to claim 9, wherein independent exciting means are provided for the material supporting member and the baffle means.

11. Apparatus for promoting material flow from a storage bin or hopper comprising a material supporting member having a discharge opening therein and adapted to be mounted beneath the outlet of the bin or hopper, mounting means for said member comprising means fixedly securing the periphery of said member at a plurality of positions relative to said bin or hopper, baffle means disposed in spaced relationship above the discharge opening to prevent direct flow of material therethrough, means for exciting said material supporting member at or in the region of a resonant frequency thereof, and means for exciting said baffle means at or in the region of a resonant frequency thereof, so as to promote predominantly flexural vibration of said material supporting member and said baffle means, said material supporting member being mounted upon said bin or hopper, and said baffle member being mounted on said bin or hopper, and a flexible annulus sealingly connecting the outlet of said bin or hopper to said material supporting member, said mounting means comprising an annular baffle mounting member secured upon and across the outlet of said bin or hopper and said baffle being fixed thereupon, said material supporting member being rigidly secured to said baffle mounting member, and said flexible annulus extending between said baffle mounting member and said material supporting member.

* * * * *